United States Patent [19]

Schuierer

[11] Patent Number: 4,466,149

[45] Date of Patent: Aug. 21, 1984

[54] METHOD AND APPARATUS FOR RINSING TEXTILE MATERIAL

[75] Inventor: Manfred Schuierer, Michelstadt, Fed. Rep. of Germany

[73] Assignee: Bruckner Apparatebau GmbH, Erbach, Fed. Rep. of Germany

[21] Appl. No.: 409,506

[22] Filed: Aug. 19, 1982

[30] Foreign Application Priority Data

Sep. 22, 1981 [DE] Fed. Rep. of Germany ..... 3137663

[51] Int. Cl.[3] ..... D06B 1/02; D06B 17/02

[52] U.S. Cl. ..... 8/151; 68/20; 68/205 R

[58] Field of Search ..... 68/20, 62, 176, 177, 68/178, 180, 205 R; 8/151, 152

[56] References Cited

U.S. PATENT DOCUMENTS 3,762,866 10/1973 Rayment et al. ..... 68/178 X
3,848,438 11/1974 Tachibana et al. ..... 68/22 R

FOREIGN PATENT DOCUMENTS 0016350 10/1980 European Pat. Off. ..... 68/177
274,703 7/1927 United Kingdom ..... 68/177

*Primary Examiner*—Philip R. Coe
*Attorney, Agent, or Firm*—Learman & McCulloch

[57] ABSTRACT

Rinsing of textile material is accomplished in a tank having a rinsing zone through which the material passes upwardly from a resting zone. Rinsing fluid is applied to the upwardly moving material exclusively in the rinsing zone and in a quantity greater than that which the material can carry with it during its upward movement.

20 Claims, 7 Drawing Figures

METHOD AND APPARATUS FOR RINSING TEXTILE MATERIAL

BACKGROUND OF THE INVENTION

The invention relates to a method and apparatus for rinsing textile material in a wet treatment tank which has at least one zone in which rinsing fluid is applied to the textile material and at least one other zone which is free of rinsing fluid and in which the textile material rests before it is again exposed to the action of the rinsing fluid.

In a known method of rinsing textile material (British Pat. No. 237,422) the textile material traverses the tank in the form of a continuous hank, and the fluid outlet (in the lower region of the tank) is open. In this method, rinsing fluid (fresh water) is sprayed onto the strand of textile material rising upwards from the lower region of the tank and also onto the strand of textile material extending downwards into the resting zone after passing through a pair of squeeze rollers. This method has the disadvantage that it requires a large quantity of rinsing fluid.

The applicants have developed a rinsing process (European Patent Specification No. A80 100 896) which also uses a resting zone which is free of rinsing fluid but in which the maximum quantity of rinsing fluid (fresh water) applied to the textile material is the quantity which the material can carry on entering the resting zone. Such a method is distinguished by a significant reduction in the quantity of rinsing fluid required and thus in particular reduces the expenditure on waste water purification.

SUMMARY OF THE INVENTION

The object of the invention is to improve on the aforementioned prior methods and apparatuses and provide a rinsing method of the general type described and achieve an optimum as regards the time taken for the rinsing process, and the quantity of rinsing fluid required.

This object is achieved according to the invention by applying the rinsing fluid exclusively to a rising strand of the textile material and in a quantity which exceeds the quantity of fluid which the textile material is capable of carrying with it in its upward movement.

In contrast to the technique disclosed in British Pat. No. 237,422, the rinsing process according to the invention includes no addition of rinsing fluid to the strand of textile material which extends downwards (i.e. towards the resting zone). In fact the proportion of the rinsing fluid supplied to the strand of material extending downwards towards the resting zone has proved to be much less effective for the rinsing action than the proportion of the rinsing fluid supplied to the rising strand leaving the resting zone. This is related amongst other things to the fact that the resting zone is kept free of fluid so that rinsing fluid which is supplied to the downward-moving strand of textile material can only act on the textile material for a relatively short period of time. By supplying rinsing fluid only to the rising strand of textile material a considerable reduction in the quantity of rinsing fluid required is achieved by comparison with the method according to British Pat. No. 237,422.

In contrast to the method according to European patent specification No. A80 100 896, the present method contemplates the supplying of rather more rinsing fluid to the rising strand of textile material than the textile material is able to carry with it in its upward movement. The excess quantity of rinsing fluid consequently runs downwards on the rising strand of textile material, thus moving in the opposite direction to the textile material. Thus the rinsing process is greatly intensified and the rinsing time is considerably shortened with a comparatively small additional quantity of fluid.

DESCRIPTION OF THE DRAWINGS

Methods according to the invention and apparatus for carrying out the methods are explained in greater detail in connection with the description of several embodiments which are illustrated in the drawings, in which.

DETAILED DESCRIPTION

Figure 1:
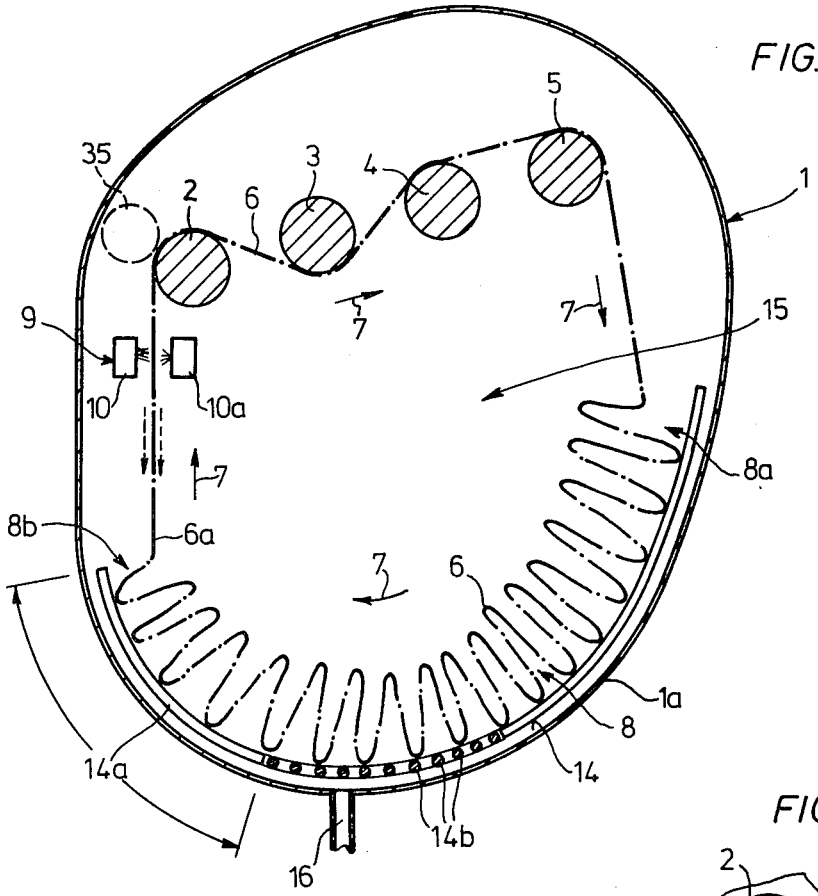
FIG. 1 is a schematic cross-sectional view through a first embodiment of a wet treatment tank.

Of the apparatus for carrying the rinsing method, only the wet treatment tank 1 with the parts necessary for explanation of the invention are shown in FIG. 1.

In its upper portion the tank 1 contains for example, four guide and carrier rollers 2 to 5 which are arranged in a conventional manner parallel to each other and one behind the other, the web textile material 6 to be treated being at least partially wrapped around these rollers, as shown; at least some of these rollers 2 to 5 can be driven in a conventional manner by an external drive so that the textile material 6 can be conveyed through the tank 1 in the direction of the arrows 7. The roller 2 forms a web turning zone at a level above that of the tank 1.

The tank 1 also has in its lower half a resting zone 8 which is free of rinsing fluid and in which the textile material 6 rests. In the embodiment of FIG. 1 the resting zone 8 is formed by constructing approximately the lower half of the tank 1 in the form of a storage area for the textile material 6 with a base 1*a* which is curved downwards. The resting zone 8 has an inlet end 8*a* for the textile material in the region below the last guide and carrier roller 5 and an outlet end 8*b* for the textile material located a sufficient distance below the first carrier roller 2, viewed in the direction of conveyance of the textile material (arrow 7). In the region between the outlet end 8*b* of the resting zone 8 and the first guide and carrier roller 2 there is a zone in which a nozzle assembly 9 is supported to spray rinsing fluid from a source thereof onto the textile material 6. As can be seen by the direction of conveyance (arrow 7) of the textile material 6, the nozzle assembly 9 applies the rinsing fluid to the rising strand 6*a* of the textile material, and only in this section. Known control devices (not shown)

are used to measure the quantity of rinsing fluid so that it exceeds the quantity of fluid which the textile material 6 is capable of carrying with it in its upward movement (arrow 7).

On both sides of the textile material 6 and 6*a* the nozzle assembly 9 contains spray nozzles 10, 10*a* which can be adapted to the textile material to be treated. That is, if textile material in the form of hanks is to be treated then a ring nozzle of known construction which completely or almost completely surrounds the textile material is particularly suitable, whereas for flat textile material a correspondingly wide spray nozzle can be arranged on either side of the material.

Figure 2:
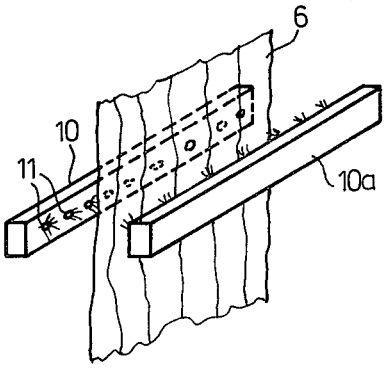
FIG. 2 is a perspective view of the nozzle arrangement for supplying rinsing fluid.

FIG. 2 shows an embodiment of the spray nozzles 10, 10*a* between which the textile material 6 is passed in a flat state. Each of these spray nozzles is formed by a nozzle body which corresponds in length to the greatest possible width of the textile material and is arranged at right angles to the textile materials. Each nozzle body can either have one single nozzle slot extending over the whole working width (as is known) or it can have a number of individual nozzle orifices 11 as is illustrated in FIG. 2, from which the rinsing fluid is sprayed at relatively high pressure onto the corresponding side of the textile material 6.

Figure 3:
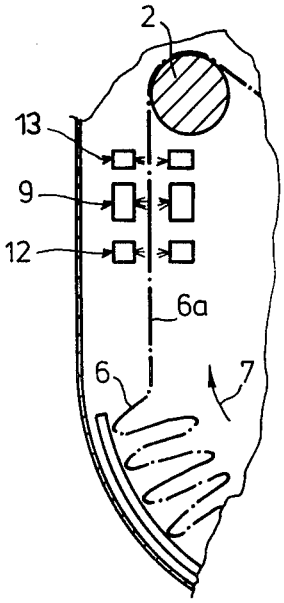
FIG. 3 is a partial cross-sectional view (similar to FIG. 1) and illustrating an additional air blowing arrangement in the region of the nozzle arrangement.

If it is assumed that flat textile material 6 is to be rinsed in the wet treatment tank 1, then it is particularly advantageous if an air blower assembly is also provided in front of and/or behind the nozzle assembly 9. As is shown in FIG. 3, a set of air jet nozzles 12, 13 is supported on either side of the textile material 2 both upstream and downstream of the nozzle assembly 9. These sets of air jet nozzles 12, 13 serve to keep the textile material 6 spread out flat, but they also aid the rinsing effect of the rinsing fluid.

Provided in the region of the resting zone 8 in the wet treatment tank 1 is a carrier 14 which is spaced from the downwardly curved based 1*a* and extends to the outlet end 8*b* of the resting zone 8, i.e. into the region below the nozzle assembly 9. In the example according to FIG. 1 the carrier is in the form of a grill 14. This grill 14 preferably has a section 14*a* impermeable to the rinsing fluid in the region of the outlet end 8*b* of the resting zone 8. The rest of the grill, on the other hand, is permeable to fluid and can be constructed for example in the form of a conventional slide grill. As regards the construction of the grill 14 it is also possible for this to be at least partly in the form of a roller grill as indicated by broken lines at 14*b* in the lower section.

Textile material 6 in the apparatus described above can be treated with rinsing fluid according to the following method:

It is assumed from the outset that the wet treatment tank 1 according to FIG. 1 has one single chamber, namely the chamber 15 which is shown in cross-section and in which the textile material 6 is rinsed intermittently in continuous circulation. The textile material 6 is conveyed through the tank 1 in the direction of the arrow 7 and the strand 6*a* thereof rising from the resting zone 8 which is free of rinsing fluid enters a zone in which rinsing fluid is sprayed under pressure onto both sides of the textile material 6 with the aid of the nozzle assembly 9. The rinsing fluid is applied exclusively to this rising strand 6*a* of the textile material 6 and in a quantity which exceeds the quantity of fluid which the textile material 6 is capable of carrying with it in its upward movement. This means that the proportion of the rinsing fluid in excess of the quantity which the textile material is capable of bearing flows downwards countercurrent to the rising strand of textile material and takes with it the dirt which has already been dissolved out. Because of the presence of the impermeable grill section 14*a* the downwardly flowing quantity of fluid runs downwards on the grill section 14*a* in constant contact with the section of textile material 6 resting on this section which favors the rinsing of the textile material 6.

Depending upon the requirements, the textile material 6 can be rinsed with cold or heated fluid, water or fresh water being principally used as the rinsing fluid.

If cold fresh water is to be used as the rinsing fluid then it is sufficient to connect the nozzle assembly 9 to a water pipe, and it is merely necessary to ensure the necessary pressure.

Figure 4:
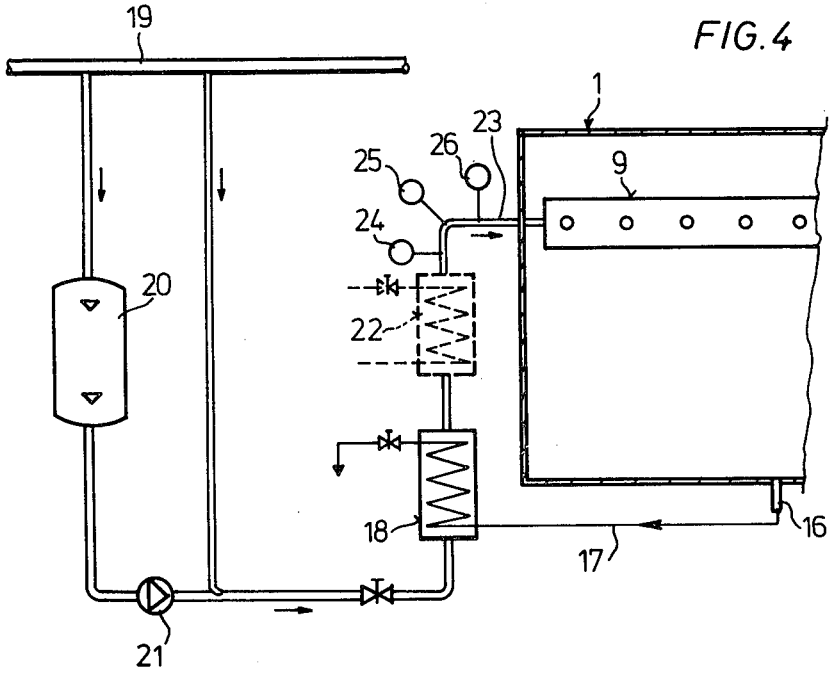
FIG. 4 is a schematic view illustrating heating of the fresh rinsing fluid.

For the supply of hot rinsing fluid corresponding heating arrangements are necessary, and arrangements which are known per se can be used for this. A particularly advantageous and energy-saving embodiment is shown in FIG. 4 in a simplified schematic form in which for the sake of simplicity the same wet treatment tank 1 as in FIG. 1 with the associated nozzle assembly 9 is used. The wet treatment tank 1 has at its lower end at least one rinsing fluid outlet 16 which is normally open. The dirty water or other rinsing fluid which is still warm runs out of this outlet via a pipe 17 and through an indirect heat exchanger 18. Fresh rinsing fluid, preferably fresh water, is supplied from a fresh water pipe 19 either directly or via an intermediate tank 20 and a pump 21 to the heat exchanger 18 in which it is indirectly heated by the dirty rinsing fluid from the tank 1, and this results in an extremely advantageous recovery of waste heat. As indicated by broken lines, a second heat exchanger 22, in which the fresh rinsing fluid to be supplied to the nozzle assembly 9 can optionally be heated to the necessary final temperature, is coupled to the heat exchanger 18. Pressure measuring and setting apparatus 24, a thermometer 25, and a feeder valve 26 of conventional construction can be arranged in the fluid supply line 23 between the second heat exchanger 22 and the nozzle assembly 9.

Figure 5:
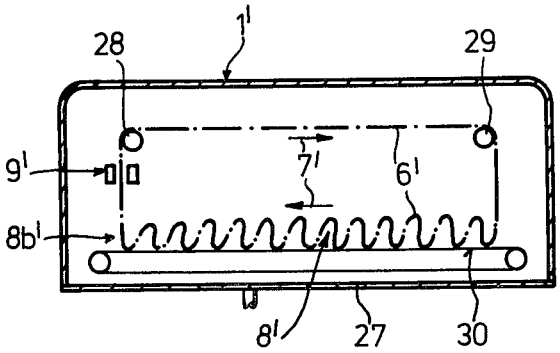
FIG. 5 is a schematic cross-sectional view through a second embodiment of wet treatment tank.

FIG. 5 shows in a further simplified schematic form (cross-sectional view) another embodiment of a wet treatment tank 1' which is constructed with an approximately rectangular cross-section but in any case has an approximately flat base 27. In the upper part of this tank 1' a plurality of guide and carrier rollers 28, 29 (only two are shown) can be provided to convey the textile material 6' which is to be treated through the tank 1' (at least through the upper part thereof) in the direction of the arrow 7'. In this case the resting zone 8' for the textile material 6' is formed essentially by a carrier 30 which supports the textile material and extends substantially at right angles over the base 27 of the tank 1' and is formed for example by an endless, continuously circulating screen belt so that it is permeable to the rinsing fluid. This carrier 30 thus extends through the whole resting zone 8' as far as the outlet end 8*b'* thereof in the region below the nozzle assembly 9' which is constructed in the manner described above in connection with FIG. 1 and is arranged between the outlet end 8*b'* and the first guide and carrier roller 28.

Figure 6:
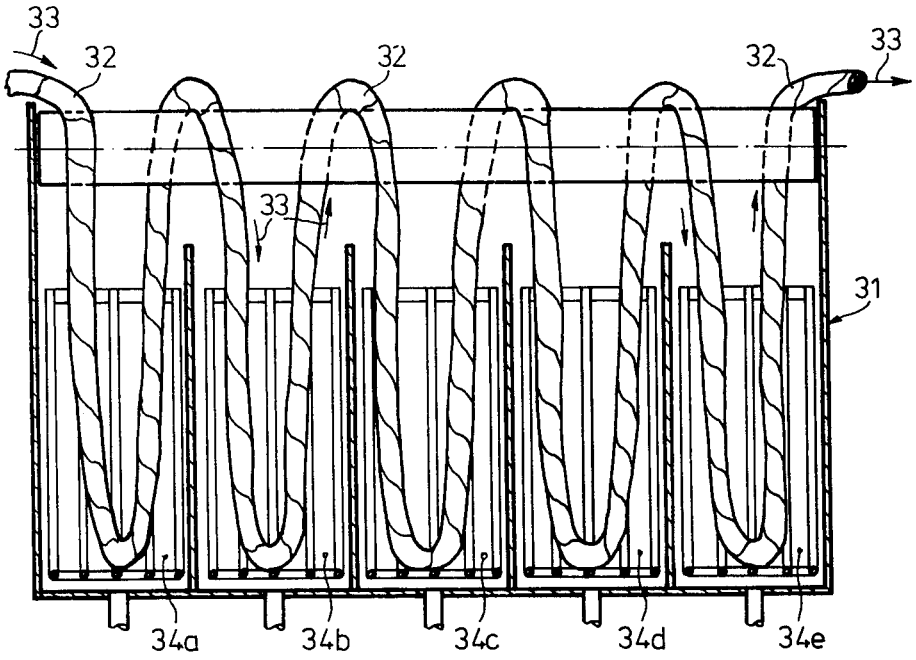
FIG. 6 is a simplified, schematic, longitudinal sectional view through an embodiment of a wet treatment tank having several chambers for continuous treatment of the textile material.

FIG. 6 shows a further simplified longitudinal section of a wet treatment tank 31. This wet treatment tank has a plurality of chambers 34*a*–34*e* through which the textile material 32 passes in succession in the direction of the arrows 33. Each of these chambers 34*a*–34*e* can be constructed in the same manner as already described in relation to FIGS. 1–5, so that a cross-sectional view of one of these chambers is unnecessary and the parts arranged therein (including the nozzle assemblies) do not need to be illustrated in FIG. 6. The graphic representation of FIG. 6 clearly shows that this wet treatment tank 31 with its chambers 34a–34e is particularly well suited to continuous rinsing of the textile material 32; the textile material enters the tank 31 at the first chamber 34a and leaves the tank 31 from the last chamber 34e, and a thorough rinsing treatment takes place in each of these chambers 34a–34e.

Figure 7:
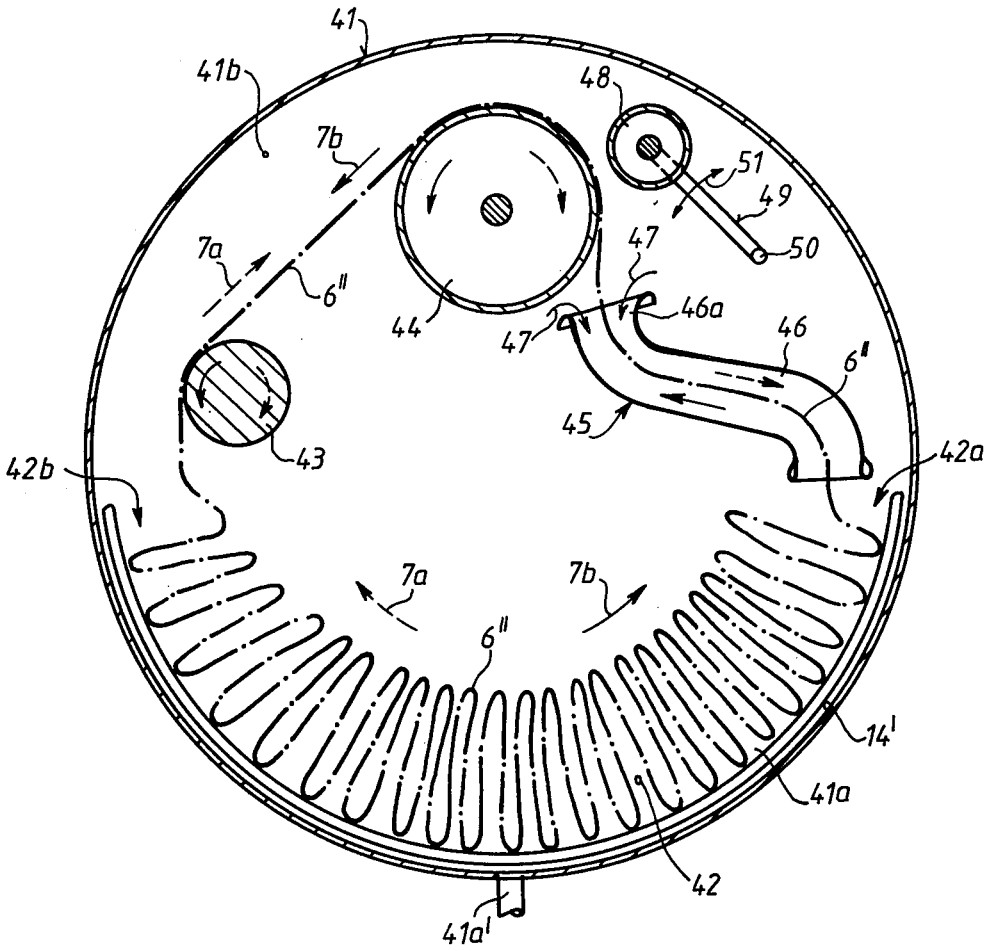
FIG. 7 is a schematic sectional view through a further embodiment which can be used for dyeing as well as for rinsing.

A further particularly advantageous embodiment is shown in FIG. 7 in greatly simplified form. The wet treatment tank 41 in this case can be approximately circular, as shown, or oval in cross-section. In contrast to the preceding embodiments, this embodiment of the apparatus and in particular of the tank 41 is intended for alternate or successive dyeing and rinsing treatment.

A slide grill 14' can be arranged a small distance above the tank base in the lower part 41a of the tank in a manner which is essentially similar to that described in connection with FIG. 1. Thus a downwardly curved store which forms a resting zone 42 for the textile material 6'' and in which this textile material is supported on the slide grill 14' is constructed in the lower part 41a of the tank. This resting zone 42 extends between its ends 42a and 42b which point approximately in the peripheral direction of the tank over the greater part of the lower part 41a of the tank.

A suitable number of guide and carrier rollers for the textile material 6'' can be provided in the upper part 41b of the tank. In the embodiment according to FIG. 7 two such guide and carrier rollers are provided, one guide roller 43 which is somewhat smaller in diameter being arranged in the region above the end 42b of the resting zone and a sufficient distance above it while a carrier roller 44 which has a greater diameter than the guide roller 43 is arranged approximately in the central upper sector. It is also important that an overflow or jet system 45 which is known per se and contains a conveying channel 46 for the textile material 6'' is provided in the region between the carrier roller 44 and the lower part 41a of the tank or the lower end 42a of the resting zone. At the upper end 46a of this conveying channel 46, i.e., relatively close below the point of contact facing it between the carrier roller 44 and the textile material 6'', the system 45 has a fluid supply which for the sake of simplicity is merely indicated by arrows 47. A squeeze roller 48 rotatably mounted in a support 49 is also associated with the carrier roller 44 in the region above the upper end 46a of the conveying channel, and the support 49 in turn is arranged on a shaft 50 so as to be rotatable in the direction of the double arrow 51. In this way the squeeze roller 48 can be swung and pressed against the carrier roller 44 in case of need which will be explained in detail below; when not required the squeeze roller 48 is swung away from the carrier roller 44.

As has already been stated above, the apparatus can be used in this embodiment (FIG. 7) both for dyeing and for rinsing, these two treatments generally being carried out in succession on the same textile material 6''. For this purpose the direction of conveyance of the textile material by the guide and carrier rollers 43, 44 is reversible in such a way that during dyeing the textile material 6'' is conveyed in the direction of the broken arrows 7a and during rinsing in the direction of the solid arrows 7b.

Assuming that the wet treatment tank 41 is first of all set for dyeing, then the textile material 6' is led out of the resting zone 42 at the end 42b thereof in the direction of the arrows 7a and passes over the guide roller 43 onto the carrier roller 44 from which the squeeze roller 48 has been removed. The textile material 6'' is led from the carrier roller 44 into the conveying channel 46 of the overflow or jet system 45, and the introduction of the textile material 6'' and passage thereof through this conveying channel 46 is favourably assisted by the supply of dye fluid (arrow 47). Thus, this system 45 forms a conveying connection from the carrier roller 47 to the other end 42a of the resting zone 42.

If after dyeing the textile material 6'' is also to be rinsed in the tank 41, then first of all the fluid located in the lower part 41a of the tank is drained off through the lower outlet 41a'; this outlet 41a' then remains open during the rinsing operation. The drive or the direction of conveyance of the textile material by the carrier roller 44 is then reversed according to the arrow 7b. After this switching over from dyeing to rinsing, the textile material 6'' is then drawn out of the resting zone 42 at the end 42a and passed with its rising strand first through the conveying channel 46 of the overflow or jet system 45. Rinsing fluid is then supplied to this rising strand of textile material 6'' exclusively in the region of this system 45 at the upper end 46a of the conveying channel 46 according to the arrows 47. However, during this rinsing operation the squeeze roller 48 is at the same time pressed against the periphery of the carrier roller 44 so that rinsing fluid is squeezed out of the textile material 6'' in this region and this squeezed out rinsing fluid runs downwards along the textile material 6'' so that the exchange of material and thus the rinsing of the textile material is greatly intensified.

In addition to the embodiments described above, further variations and developments are, of course, possible. Thus, for example in the embodiment according to FIG. 1 it is possible to associate a squeeze roller 35 with the guide roller 2 downstream from the nozzle assembly 9 in such a way that the rinsing fluid which is squeezed out can flow downwards countercurrent to the rising textile material 6. In this case the squeeze roller 35 could be substantially fixed (not pivotable) in relation to the roller 2. In addition the flat textile material can also be kept flat by blowing on air or with the aid of suitably directed nozzles or jets from the spray nozzles (e.g. 10, 10a), as can be easily understood from FIG. 2. On the other hand, if the textile material is not in the flat state but in the form of hanks when it is to be treated with rinsing fluid, then the sets of nozzles intended for blowing air can also be constructed in such a way that the additional jet of air causes the hank of textile material to be opened in the region where the rinsing fluid is applied, and as a result the penetration of the rinsing fluid into the textile material or the hank thereof is assisted in a most advantageous manner.

Finally, two working examples will be explained briefly.

EXAMPLE 1

In apparatus corresponding substantially to that of FIG. 1, conveying speeds of between 20 and 40 m/min, depending upon the respective quality of the material were used for rinsing textile material (in contrast thereto dyeing takes place at conveying speeds between 80 and 120 m/min). Rinsing fluid was sprayed onto the textile material in a ratio of 1:5, i.e. 5:1 or 5 kg water were sprayed onto each 1 kg of textile material. Depending upon the quality of the textile material and optionally on the speed, good results could be obtained with material fluid ratios in the range of 1:3 and 1:10.

EXAMPLE 2

In apparatus corresponding substantially to that of the embodiment according to FIG. 7 the textile material was first dyed and then rinsed in the same treatment tank. During the dyeing process the lower part of the tank contained a dye bath in a known manner. The textile material was conveyed in a circulatory manner, first being led over the guide and carrier rollers and from there was washed into the conveying channel of the overflow or jet system; a large quantity of dye liquor was used in order to wash the textile material along. After dyeing, the dye liquor was drained out of the tank and the direction of conveying by the guide and carrier rollers was reversed, and the tank was operated with the fluid outlet open. It was also considered advisable for the conveying speed, which for dyeing was between 80 and 140 m/min, to be reduced for rinsing to approximately 20 to 50 m/min. By reversing the direction of conveyance for the textile material, during rinsing the rising strand of textile material was first passed through the conveying channel of the overflow or jet system where a quantity of rinsing fluid was supplied to the textile material at the upper end of the conveying channel, the quantity of rinsing fluid being somewhat greater than that which the textile material is capable of carrying with it in its upward movement. The weight ratio between textile material and rinsing fluid to be applied was in the range of approximately 1:3 and 1:10 (with a favorable middle range in the ratio 1:5). The result was a particularly thorough exchange of material in the conveying channel and an extraordinarily good rinsing capacity.

In both working examples it was also observed that the necessary quantity of rinsing fluid can be considerably reduced if a squeeze roller is also associated with the guide and carrier roller which is first reached by the rising strand of textile material.

I claim:

1. A method of rinsing an elongate web of textile material comprising introducing said web to a liquid free resting zone; moving said web from said resting zone following a rest period upwardly toward a web turning zone located at a level above that of said resting zone; and applying to the upwardly moving web only and at a rinsing zone between said resting zone and said turning zone a quantity of rinsing fluid, said quantity of rinsing fluid being in excess of that which said upwardly moving web can carry, whereby the excess of said rinsing fluid flows downwardly along the upwardly moving web between said rinsing zone and said resting zone.

2. The method according to claim 1 including applying the rinsing liquid to said textile material on both sides of the latter.

3. The method according to claim 1 wherein the textile material is in hank form.

4. The method according to claim 1 wherein the textile material is in flat form.

5. The method according to claim 1 including applying said liquid to said material in a spray.

6. The method according to claim 5 including directing said spray onto said material in such manner as to spread said material.

7. Apparatus for the rinsing of an elongate web of textile material comprising a tank having therein means forming a web resting zone free of liquid; means for introducing said web to said resting zone; means for moving said web upwardly from said resting zone toward and beyond a rinsing zone located at a level above that of said resting zone; web turning means at a level above that of said rinsing zone; and means at said rinsing zone for applying a rinsing liquid to said upwardly moving web only and in a quantity in excess of that which said upwardly moving web can carry, whereby the excess of said rinsing liquid flows downwardly along the upwardly moving web between said rinsing zone and said resting zone.

8. Apparatus according to claim 7 wherein said resting zone has an outlet end and wherein the means for applying said liquid to said material is located at a level above that of said outlet end.

9. Apparatus according to claim 7 wherein the means for applying said liquid to said material comprises a nozzle assembly.

10. Apparatus according to claim 9 wherein said nozzle assembly includes nozzles located on opposite sides of said material.

11. Apparatus according to claim 7 including air blower means adjacent said rinsing zone for blowing air onto said material.

12. Apparatus according to claim 7 including means for conveying said material from said rinsing zone to said resting zone, said moving means and said conveying means being reversible whereby said material selectively may be moved from said resting zone to said rinsing zone and vice versa.

13. Apparatus according to claim 7 including squeeze means associated with said material means for applying compressive force on said material.

14. Apparatus according to claim 13 wherein said squeeze means comprises a roller swingable into and out of engagement with said material.

15. Apparatus according to claim 7 wherein said tank has a plurality of chambers through which said material passes in succession, each of said chambers having a rinsing zone, a resting zone, and means for applying rinsing liquid to said material.

16. Apparatus according to claim 7 wherein said tank has a curved lower portion on which is a material carrier at least a portion of which is permeable to said rinsing liquid.

17. Apparatus according to claim 7 wherein said tank has a substantially flat bottom on which is an endless, continuously circulating material carrier permeable to said rinsing liquid.

18. Apparatus according to claim 7 including means for heating said rinsing liquid.

19. Apparatus according to claim 7 including means for draining said tank.

20. Apparatus according to claim 19 including means for recirculating liquid drained from said tank.

* * * * *